US007487873B2

(12) United States Patent
Larsson et al.

(10) Patent No.: US 7,487,873 B2
(45) Date of Patent: Feb. 10, 2009

(54) PACKING FOR A STACK OF TISSUE PAPER OR NONWOVEN

(75) Inventors: Bjorn Larsson, Billdal (SE); Inger Andersson, Lindome (SE)

(73) Assignee: SCA Hygiene Products AB, Gothenburg (SE)

( * ) Notice: Subject to any disclaimer, the term of this patent is extended or adjusted under 35 U.S.C. 154(b) by 539 days.

(21) Appl. No.: 10/859,352

(22) Filed: Jun. 3, 2004

(65) Prior Publication Data

US 2004/0245140 A1 Dec. 9, 2004

Related U.S. Application Data

(60) Provisional application No. 60/475,003, filed on Jun. 3, 2003.

(51) Int. Cl.
*B65D 73/00* (2006.01)
*B65D 85/67* (2006.01)

(52) U.S. Cl. ..... 206/494; 206/449; 206/812

(58) Field of Classification Search ..... 206/494, 206/460, 813, 812, 232, 233, 450, 447, 495, 206/451, 484, 800, 449
See application file for complete search history.

(56) References Cited

U.S. PATENT DOCUMENTS

| | | | | | |
|---|---|---|---|---|---|
| 2,380,367 | A * | 7/1945 | Ranney | 426/5 |
| 3,442,372 | A * | 5/1969 | Di Giacomo et al. | 206/471 |
| 3,684,086 | A | 8/1972 | Harrison | |
| 4,627,219 | A * | 12/1986 | Omori | 53/399 |
| 4,681,240 | A | 7/1987 | Wyant | |
| 4,776,649 | A | 10/1988 | Ten Wolde | |
| 5,033,620 | A | 7/1991 | De Luca | |
| 5,217,772 | A * | 6/1993 | Brown et al. | 428/41.3 |
| 5,522,205 | A * | 6/1996 | Weder | 53/475 |
| 5,797,494 | A * | 8/1998 | Balling et al. | 206/460 |
| 6,039,179 | A * | 3/2000 | Weder et al. | 206/423 |
| 6,286,712 | B1 | 9/2001 | Craig et al. | |
| 6,880,704 | B2 * | 4/2005 | Bredahl | 206/494 |
| 7,032,754 | B2 * | 4/2006 | Kopecky | 206/460 |
| 2002/0192433 | A1 | 12/2002 | Huang et al. | |
| 2004/0064122 | A1 * | 4/2004 | Hansson | 604/385.02 |

FOREIGN PATENT DOCUMENTS

| | | |
|---|---|---|
| DE | 43 36 933 | 5/1995 |
| EP | 0 779 053 | 6/1997 |
| EP | 0 861 791 | 9/1998 |
| EP | 0 393 254 | 12/2000 |

* cited by examiner

*Primary Examiner*—Mickey Yu
*Assistant Examiner*—Steven A. Reynolds
(74) *Attorney, Agent, or Firm*—Young & Thompson

(57) ABSTRACT

A packing for a stack of tissue paper or nonwoven, where the top and/or bottom layer is provided on its outside with at least one glue layer, which packing comprises a packing wrapper. The packing wrapper has, at least within the area of each glue layer, a small capacity to adhere to the glue layer(s) of the stack on at least the side which faces the stack.

15 Claims, 3 Drawing Sheets

PACKING FOR A STACK OF TISSUE PAPER OR NONWOVEN

CROSS REFERENCE TO RELATED APPLICATION

This application claims the 35 U.S.C. § 119(e) benefit of prior Provisional Application Ser. No. 60/475,003 filed on Jun. 3, 2003.

FIELD OF THE INVENTION

This invention relates to a packing for a stack of tissue paper or nonwoven, where the top and/or the bottom layer(s) in the stack of tissue paper or nonwoven is/are provided with a glue layer, which packing comprises a packing wrapper.

BACKGROUND OF THE INVENTION

Nonwoven drying cloths and tissue paper, such as toilet paper, paper towels and industrial drying cloths, are often sold zigzag-folded in stacks. These stacks can consist of individual drying cloths which are interfolded, of two perforated continuous webs which have been folded together or of a single continuous web. The stacks are often placed in dispensers which are refilled with a new stack before the first stack has run out. One problem with such dispensers is that the cloths/the webs/the web from one stack are not interfolded with or connected to the cloths/the webs/the web in the next stack, and the cloths/the webs/the web in the new stack will thus not be fed automatically when the first stack runs out. This makes it difficult to extract the products from a dispenser when one stack has run out and the next is to be started. The stacks described in EP-A1-0,393,254 solve the problem by providing the top layer in the stack with a glue layer which is covered by a release-agent-treated covering paper. Moreover, the stacks are often provided with some kind of packing wrapper, for example paper or plastic foil. This means that the packing of the stacks consists of both a covering paper and a wrapping paper, which results in high material costs and a complicated manufacturing process.

The object of the invention is to produce an improved packing for a stack of tissue paper or nonwoven, which packing requires less packing material and is simpler to manufacture than known stacks.

SUMMARY OF THE INVENTION

This object is achieved by means of a packing for a stack of tissue paper or nonwoven where the top and/or bottom layer in the stack is provided with a glue layer on its outside. The packing comprises a packing wrapper which, at least within the area of each glue layer, has a small capacity to adhere to the glue layer(s) of the stack on the side which faces the stack. By virtue of this, the packing wrapper can be removed without the adhesive properties of the glue layer(s) of the stack being impaired appreciably when removal takes place. By virtue of the fact that the packing wrapper can be detached from the glue layer(s) of the stack, no additional packing material which covers these glue layers is necessary, making it possible to use a smaller quantity of material. Moreover, only one packing step is required in order both to cover the glue layer(s) of the stack and to enclose the stack in a packing wrapper.

In a first embodiment, the entire packing wrapper has a small capacity to adhere to the glue layer(s) of the stack at least on the side which faces the stack. In another embodiment, only parts of the packing wrapper have such a small adhesive capacity. In a further embodiment, the packing wrapper has a small adhesive capacity only within the area of each glue layer.

The small adhesive capacity of the packing wrapper can be brought about in various ways. In one embodiment, the packing wrapper is provided with a separate material piece having a small capacity to adhere to the glue layer of the stack. The material piece is attached to the packing wrapper, the connecting force between the material piece and the packing wrapper being stronger than the connection between the material piece and the glue layer of the stack. This means that when the packing wrapper is removed, the connection between the material piece and the packing wrapper remains.

In a second embodiment, the packing wrapper is provided with a small adhesive capacity by virtue of a release agent being applied to the packing wrapper. The release agent can be applied either directly to the packing wrapper or to the material piece mentioned above. The release agent can be applied over the entire surface of the packing wrapper, over part of the surface of the packing wrapper or over only that part of the surface of the packing wrapper which covers the glue layers.

In a third embodiment, a small adhesive capacity between the packing wrapper and the glue layer of the stack has been brought about by virtue of material which itself has a low adhesive capacity having been selected. A material with a surface structure which has a small adhesive capacity is particularly suitable. An example of the latter is a packing material which is provided with a pattern of projections which bring about a small contact area between the glue layer and the packing wrapper. This pattern can be present on the entire packing wrapper or on parts of the packing wrapper, including on any material piece which is attached to the packing wrapper.

In one embodiment, the closure of the packed stack consists at least in part or preferably only of the connection of the packing wrapper to the glue layer of the stack.

BRIEF DESCRIPTION OF THE DRAWINGS

The invention will now be described with reference to accompanying figures in which.

DESCRIPTION OF THE PREFERRED EMBODIMENTS

The invention concerns a packing for a stack of tissue paper or nonwoven. The stack can consist of individual drying cloths which have been interfolded, of two perforated continuous webs which have been folded together or of a folded single continuous web. The continuous webs have often been zigzag-folded.

The figures are only diagrammatic examples of different embodiments and are not to be regarded as design drawings. Any references in the text to upper side, lower side, top and bottom are to be seen as relative positional descriptions in the figures. Packings which are placed on their side or upside down or are otherwise rotated are of course also included in the scope of protection. In the various figures, the components in the embodiment shown which correspond to similar components in the figures for the other embodiments have been given the same reference numbers with addition of ', ", ''' signs as appropriate.

Figure 1:
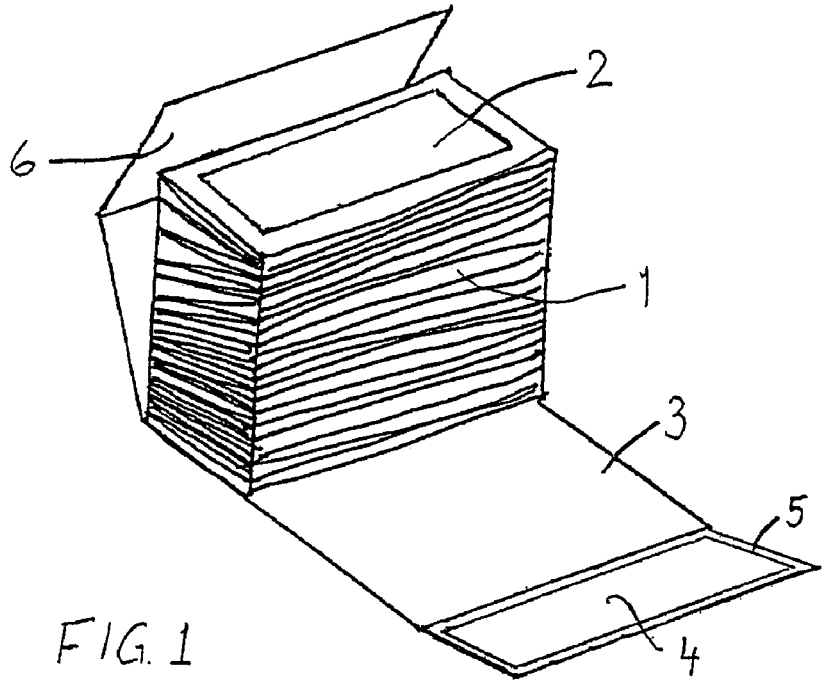
FIG. 1 shows diagrammatically a perspective view of an opened packing for a stack of folded webs in accordance with a first embodiment of the invention.
Figure 2:
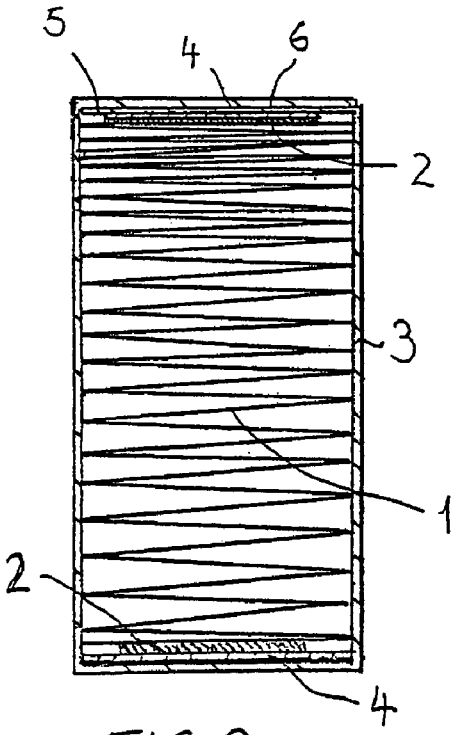
FIG. 2 shows a side view of the packing in FIG. 1 with the packing in a closed state.
Figure 3:
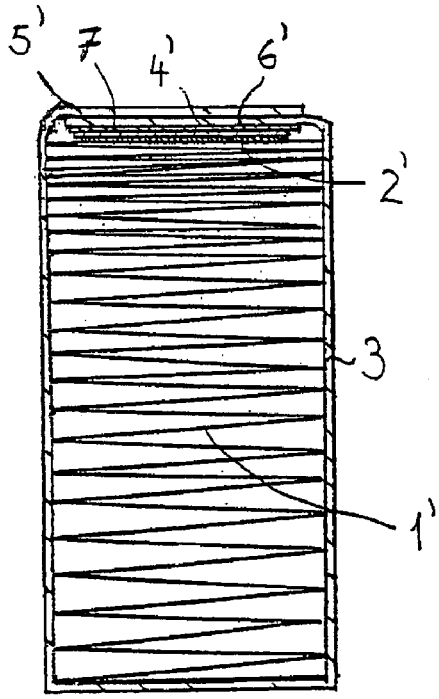
FIG. 3 shows a view similar to FIG. 2 of a packing according to an embodiment where a material piece on the packing has a low capacity to adhere to the glue layer of the stack.

FIGS. 1 and 2 show a packing for a stack 1 of a zigzag-folded web of tissue paper. On the upper side and, respectively, lower side, the top and bottom layers of the stack are each coated with a glue layer 2. The stack is packed in a packing wrapper 3 provided with a first and a second closing flap 5, 6 and is shown in FIG. 1 with the packing wrapper in an open state. That part of the packing wrapper which covers the lower glue layer is provided on its inside with a layer of release agent 4. The first closing flap 5 is likewise provided on its inside, that is to say the side facing the stack, with a layer of release agent 4 which covers the upper glue layer 2 in the closed state of the packing wrapper 3. The second closing flap 6 is attached in a suitable way to the outside of the first closing flap 5 or elsewhere on the outside of the packing wrapper, for example by means of a glue layer or by means of a fastening tape. FIG. 3 shows an embodiment where only the top layer on the upper side of the stack 1' of tissue paper or nonwoven is coated with a glue layer 2'. The glue layer is covered by a material piece 7' which has been attached to the packing wrapper 3'. The material piece 7' is provided with a layer of release agent 4'. The material piece is applied in such a way that the connecting force between the material piece and the packing wrapper is stronger than the connection between the material piece and the glue layer of the stack. This leads to the connection between the material piece and the packing means remaining even after the packing has been opened and, owing to that, the glue layer being free for use.

Figure 4:
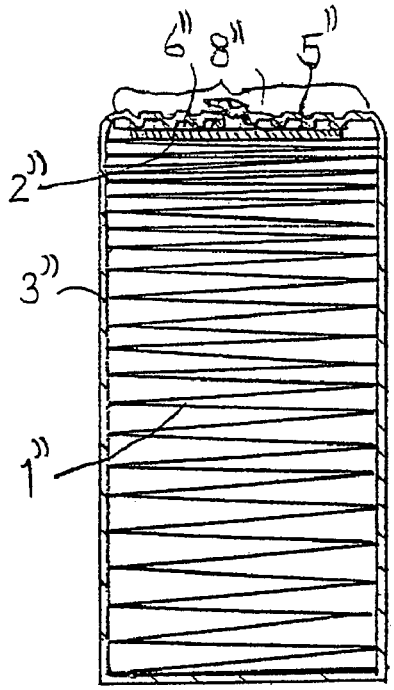
FIG. 4 shows a diagrammatic illustration of a packing wrapper which is provided with a pattern of projections.

In one embodiment, the packing material can be wholly or partly made from a material which itself has a small capacity to adhere to the glue layer; it is then not necessary to apply a release agent to the packing wrapper. The packing material can be made from, for example, a silicone or PTFE (polytetrafluoroethylene) film. According to another embodiment, the packing material has wholly or partly a surface structure with a small adhesive capacity. This surface structure can be, for example, a pattern of small projections which reduce the contact area between glue layer and packing material. FIG. 4 shows such an embodiment where only that part 8" of the packing wrapper which covers the glue layer in the closed state of the packing has been provided with a surface structure which reduces the contact area between the packing wrapper and the glue layer.

The packing wrapper 3 can be made of a thin web material, for example paper or plastic. The packing wrapper can, as in FIGS. 1-5, cover only four of the six sides of the stack but can also, above all if hygiene is very important, cover all six sides.

Figure 5:
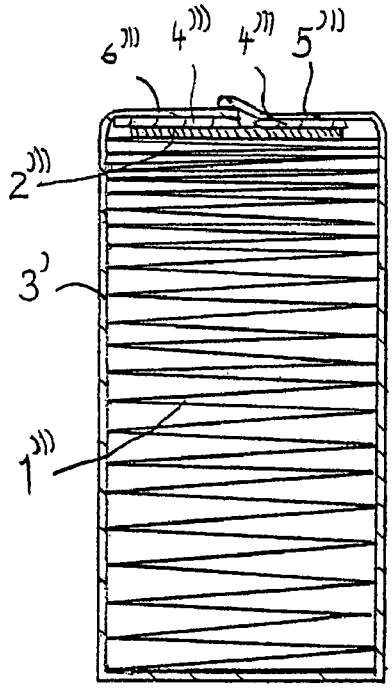
FIG. 5 shows a view similar to FIG. 2 of a packing according to an embodiment where the adhesion of the packing material to the glue layer is used for closure.

FIG. 5 shows another embodiment where the glue layer 2''' of the stack 1''' is used to close the packing wrapper 3'''. In this way, a separate closing arrangement is avoided. The embodiment shown in FIG. 5 differs from the embodiments shown in FIG. 1 in that both the first and second closing flaps 5''', 6''' are provided with a layer of release agent and dimensioned so that they extend over only part of the glue layer 2''' in the closed state of the packing wrapper. Each flap 5''', 6''' covers its own part of the glue layer. For the sake of clarity, FIG. 5 shows a small interspace between the two cover parts 4''', 4'''. This is a possible embodiment. However, it is preferred for the entire glue layer of the stack to be covered. In order to facilitate opening of the packing wrapper, one closing flap, for example the first closing flap 5''', should, as shown in FIG. 5, overlap the other closing flap slightly so as to form a gripping edge.

A small capacity to adhere to the glue layer means that the force required in order to free the packing wrapper from the glue layer is not to be greater than 0.06 N/mm, in a more preferred embodiment the force is not to be greater than 0.04 N/mm and, according to a most preferred embodiment, the force is not to be greater than 0.02 N/mm. According to one embodiment, small adhesive capacity can mean that the packing wrapper entirely lacks capacity to adhere to the glue layer. This applies in particular to the embodiment described in FIGS. 1 and 2 where one 6 of the packing flaps is attached on the outside of the packing. The capacity of the packing wrapper to adhere to the glue layer of the stack is moreover to be smaller than the capacity of the tissue paper or the nonwoven to adhere to the glue layer.

An example of a glue which can be used is a hot-melt adhesive Ecomelt H 145 NA from Collano Ebnöther AG. The packing wrapper can then be coated with silicone. ESP 39 from Loparex OY and BL 40g MGA silox D3H/0 from Akrosil are examples of suitable materials treated with silicone.

The glue layer(s) 2, 2', 2", 2''' of the stack can, as shown in FIGS. 1-5, consist of a continuous glue layer. Other possibilities are that the glue layer consists of a pattern of glue strands which can be straight or undulating, and parallel or non-parallel. The glue strands can run in the longitudinal direction or the transverse direction of the stack or at an angle to said directions. Other possible patterns are separate patches, for example circles, triangles or rectangles.

The glue layer can be applied directly to the top and/or the bottom layer of the stacks of tissue paper or nonwoven. Another way of applying the glue layer(s) to the stacks can be to provide the packing wrapper with a glue layer which is then applied to the stacks when these are packed. This method avoids a glue layer applied to a stack in advance becoming dusty or otherwise spoiled before it is covered by the packing wrapper.

Method for Measuring the Adhesive Capacity of the Packing Wrapper

Figure 6:
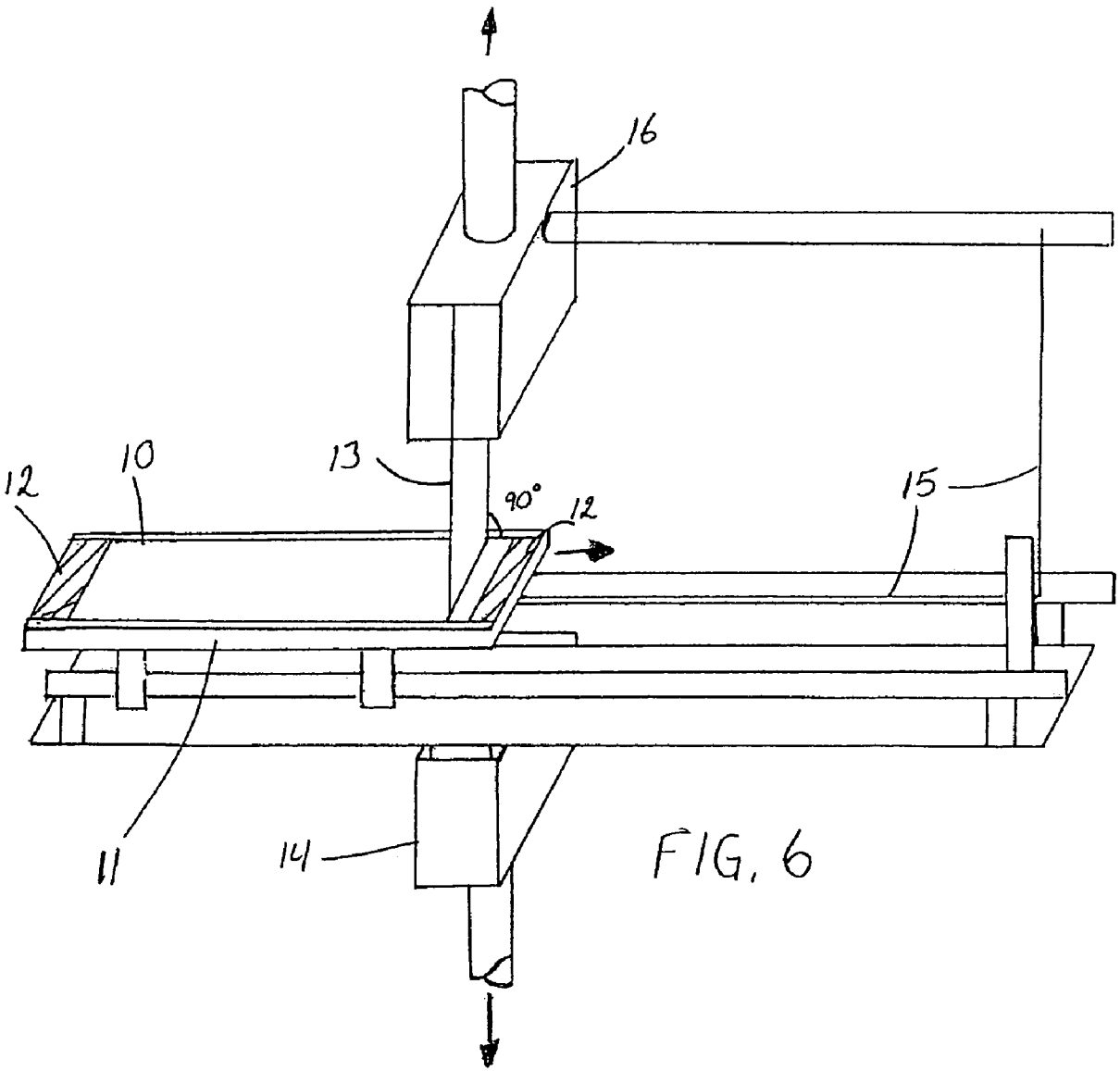
FIG. 6 shows diagrammatically part of the equipment used in order to determine the adhesive capacity of the packing wrapper.

The average force for removing a packing wrapper from a glue layer on a tissue paper or nonwoven (substrate) is measured according to the following method where the packing wrapper is removed from the glue layer at an angle of 90°. In the method, use is made of a tensile tester of the Instron or Lloyd make. Attached to this is a flat slide, with the aid of which the pulling angle is kept constant at 90° (see FIG. 6). The tissue paper or the nonwoven with the glue layer is attached to the slide by means of two metal paper fasteners.

Before measurement, the material to be measured is to have been kept for at least 24 hours in a climate with a relative humidity of 50±1% at a temperature of 23±0.5° C. This climate is also to be maintained during measurement. The sample is prepared by all the parts of the packing wrapper apart from those which cover the side or sides of the stack which is or are provided with glue being cut off. The panels of the tissue paper or the nonwoven which are not covered by the glue layer are also cut off. If the tissue paper or the nonwoven consists of a number of interconnected plies, these are to be held together during the test as well. A panel consists of the plane surface which is defined between three outer edges and a fold line or by two outer edges and two fold lines.

The sample 10 thus prepared is attached to the plane slide 11 by the paper fasteners 12 so that the packing wrapper 13 can be pulled away. The slide is mounted on the lower pulling clamp 14 of the tensile test apparatus, after which the metal wire 15 which is used to adjust the slide in position is attached in a suitable way to the upper pulling clamp 16 of the tensile tester. The pulling speed 500 mm/min and a suitable pulling length, for example 120 mm, are selected. The longer the pulling length, the more reliable the average value. The pulling length can of course not be longer than the length of the glue layer. One end of the packing wrapper is attached to the upper pulling clamp 16 in such a way that the packing wrapper forms an angle of 90° to the glue layer. If the free end of the packing wrapper is too short to reach up to the upper clamp, it can be extended with a double-folded tape which is attached to both sides of the packing wrapper. The double-folded tape is then fastened in the upper pulling clamp. Pulling is started and the average adhesion is measured. In order to avoid odd values when starting and stopping, the first and last 10 mm of the pulling distance are excluded. In order to obtain an accurate result, the final average value is based on measurements from ten products.

The invention claimed is:

1. Packing for a stack of loose sheets of tissue paper or nonwoven fiber sheet that are unconnected to each other so as to be dispensed one by one, comprising a top layer and a bottom layer of loose sheets; at least one glue layer provided only on an outer surface of at least one of only the top layer and bottom layer of loose sheets; and a packing wrapper that encompasses the stack; wherein at least within the area of each glue layer, the packing wrapper has a small capacity to adhere to the glue layer(s) of the stack of loose sheets on at least the side of the wrapper which faces the stack of loose sheets, wherein said at least one glue layer has sufficient adhesiveness at room temperature to adhere to a top or bottom sheet of an adjacent stack of loose sheets with an adhesive strength sufficient to withdraw said top or bottom sheet from a said adjacent stack, and wherein said at least one glue layer both holds the packing wrapper in encompassing relation about the stack and thereafter withdraws said top or bottom sheet from a said adjacent stack.

2. The packing according to claim 1, wherein the entire packing wrapper has a small capacity to adhere to the glue layer(s) of the stack of loose sheets on at least the side which faces the stack of loose sheets.

3. The packing according to claim 2, wherein the packing wrapper comprises of a packing material with a small capacity to adhere to the glue layer.

4. The packing according to claim 3, wherein the packing material is provided with a pattern of projections in order to bring about a small contact area between glue layer and packing wrapper.

5. The packing according to claim 1, wherein parts of the packing wrapper have a small capacity to adhere to the glue layer(s) of the stack of loose sheets.

6. The packing according to claim 5, wherein within each area of small adhesive capacity, the packing wrapper is provided with a pattern of projections in order to bring about a small contact area between glue layer and packing wrapper.

7. The packing according to claim 1, wherein the packing wrapper has a small capacity to adhere to the glue layer(s) of the stack of loose sheets only within the area of each glue layer.

8. The packing according to claim 1, wherein a material piece having a small capacity to adhere to the glue layer of the stack of loose sheets is attached to the packing wrapper, the connecting force between the material piece and the packing wrapper being stronger than the connection between the material piece and the glue layer of the stack of loose sheets so that the connection between the material piece and the packing wrapper remains even after the packing has been opened.

9. The packing according to claim 8, wherein the packing wrapper is coated with a release agent within each area of small adhesive capacity.

10. The packing according to claim 9, wherein the release agent is applied directly to the packing wrapper.

11. The packing according to claim 9, wherein the release agent is applied directly to the material piece.

12. The packing according to claim 1, further comprising a closure which includes at least in part the connection of the packing wrapper to a glue layer.

13. The packing according to claim 12, wherein the closure of the packing consists only of the connection of the packing wrapper to a glue layer.

14. The packing according to claim 1, wherein the packing wrapper is coated with a release agent within each area of small adhesive capacity.

15. The packing according to claim 1, wherein all the sheets in the stack are of identical size and shape.

* * * * *